United States Patent [19]

Dhein et al.

[11] 4,178,261

[45] Dec. 11, 1979

[54] CARBOXYLIC ACID ESTERS AND THEIR USE AS A BASE LUBRICATING OIL

[75] Inventors: Rolf Dhein; Karl-Heinz Hentschel, both of Krefeld, Fed. Rep. of Germany

[73] Assignee: Bayer Aktiengesellschaft, Fed. Rep. of Germany

[21] Appl. No.: 889,118

[22] Filed: Mar. 22, 1978

[30] Foreign Application Priority Data

Mar. 26, 1977 [DE] Fed. Rep. of Germany ..... 2713440

[51] Int. Cl.[2] ..... C10M 1/26; C11C 3/06

[52] U.S. Cl. ..... 252/57; 252/56 S; 260/410.8; 560/1; 260/410.6; 560/263; 560/1

[58] Field of Search ..... 252/56 S, 57; 260/410.6, 410.8; 560/1

[56] References Cited

U.S. PATENT DOCUMENTS

| | | | |
|---|---|---|---|
| 3,340,295 | 9/1967 | Wheeler et al. | 560/1 |
| 3,523,084 | 8/1970 | Chao et al. | 252/56 S |
| 4,045,376 | 8/1977 | Rubin et al. | 252/56 S |

*Primary Examiner*—W. J. Shine

*Attorney, Agent, or Firm*—Connolly and Hutz

[57] ABSTRACT

Carboxylic acid ester obtainable by reacting 6-cyclohexylhexanoic acid, optionally in combination with an aliphatic monocarboxylic acid which contains 4 to 20 C-atoms, completely or partially with a polyhydric alcohol, can be used as base lubricating oil.

6 Claims, No Drawings

CARBOXYLIC ACID ESTERS AND THEIR USE AS A BASE LUBRICATING OIL

The present invention relates to carboxylic acid esters, a process for their preparation and the use of these esters as base lubricating oil.

The demands which industry makes on lubricants has risen recently to such an extent that in many cases they can no longer be fulfilled by mineral oil lubricants. Synthetic lubricating substances are therefore used for lubricating machine parts and motors in which the lubricant is subjected to particularly severe conditions, for example in turbine motors for aviation. Amongst the synthetic lubricating substances, the group consisting of ester oils has proved particularly useful and valuable. When mixed with synthetic hydrocarbons or with mineral lubricating oils, ester oils can also be employed as crank-case lubricants. It is possible to prepare high temperature lubricating greases from the ester oils by adding suitable thickeners (see Ullmann 15, 333 (1964)).

Ester oils are either esters of dicarboxylic acids and straight-chain, but preferably branched, monoalcohols, esters of straight-chain or branched monocarboxylic acids and a polyalcohol, such as, for example, trimethylolpropane or pentaerythritol, or so-called "complex ester oils," which are mixed esters which are built up from components of several of the classes of compounds mentioned.

In general, ester oils are superior to mineral oils of similar viscosities because of their lower pour point, their higher flash point and their better viscosity/temperature characteristic (measured by the viscosity index, VI).

A disadvantage of the ester lubricating oils is that they are volatile at relatively high temperatures. It is indeed possible to lower the volatility by introducing bulky radicals but bulky radicals also cause a lasting impairment of the viscosity/temperature curve. The volatility can also be lowered by using higher-molecular weight carboxylic acids; however, this leads to an undesired rise in the pour point.

The problem of achieving all three properties, namely a low pour point, a favourable pattern of the viscosity/temperature curve and a low volatility, has not hitherto been solved satisfactorily.

It has now been found, surprisingly, that an optimum combination of properties can be achieved by using 6-cyclohexyl-n-hexanoic acid as an esterification component in ester lubricating oils. Oils with a low pour point, a favourable viscosity/temperature pattern and a low volatility are successfully prepared using this carboxylic acid.

According to the present invention, there are provided carboxylic acid esters obtainable by partially reacting 6-cyclohexylhexanoic acid, optionally in combination with aliphatic monocarboxylic acids which contain 4 to 20 C-atoms, with polyhydric alcohols of the formulae

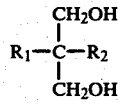

(1)

-continued

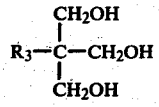

(2)

in which $R_1$ and $R_2$ are identical or different and contain hydrogen or an alkyl group with 1–5 C atoms and $R_3$ represents an alkyl radical with 1–6 C atoms or a hydroxymethyl group, glycerol, dipentaerythritol or mixtures thereof.

The polyhydric alcohols employed for the esterification are either of the type A

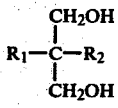

(A)

wherein $R_1$ and $R_2$ are identical or different and each denotes hydrogen or an alkyl group with 1–5 carbon atoms, or of the type (B)

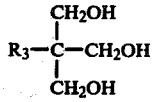

(B)

wherein $R_3$ denotes an alkyl radical with 1–6 carbon atoms or a hydroxymethyl group, glycerol, dipentaerythritol or a mixture of any thereof.

Examples of alcohols of the type A are 2,2-dimethylpropane-1,3-diol, 2-ethylpropane-1,3-diol, 2-ethyl-2-methylpropane-1,3-diol and 2,2-diethylpropane-1,3-diol. Examples of alcohols of the type B which may be mentioned are trimethylolethane, trimethylolpropane and pentaerythritol.

Alcohols of the above type B are preferred.

6-Cyclohexylhexanoic acid is described in Journal of American Chemical Society 70 (1948) 1689 et seq.

The aliphatic monocarboxylic acids with 4–20 C atoms which can optionally be employed, in addition to 6-cyclohexylhexanoic acid, for the process of the esters according to the invention are, for example, valeric acid, caproic acid, oenanthic acid, caprylic acid, pelorganic acid, capric acid, lauric acid, 2-ethylhexanoic acid, 5,5-dimethylhexanoic acid, 6,6-dimethylheptanoic acid, 3,5,5-trimethylhexanoic acid and 5,7,7-trimethyloctanoic acid, and branched $C_{18}$-monocarboxylic acids (for example "Unemac 5680", Unilever-Emery).

The monocarboxylic acids which can be optionally co-used can be employed in amounts of up to 75 mol %, preferably up to 50 mol %, of the total acid components.

However, 6-cyclohexylhexanoic acid is preferably employed as the sole acid component.

All or some of the OH groups contained in the alcohols can be esterified, but at least 80% of the OH groups present should preferably be esterified. Carboxylic acid esters which contain no further free OH groups are preferred.

The reaction is preferably carried out at temperatures from 50° to 260° C., particularly preferably from 140°–220° C., under an inert gas. Nitrogen, carbon dioxide or noble gases can be used, for example, as the inert gas. Compounds such as organic carboxylic acids, sulphuric acid, phosphoric acid, their acid salts, such as bisulphates and dihydrogen phosphates, phosphoric acid esters or dibutyl-tin oxide can be employed in catalytic amounts in the reaction as a catalyst. 0.8 to 1.3, preferably 1 to 1.2, equivalents of acid groups were reacted per equivalent of OH groups. The esterification reaction is preferably carried out azeotropically or in the melt, particularly preferably azeotropically. Aromatic hydrocarbons, such as benzene, toluene or xylene, chlorobenzene or halogen-containing hydrocarbons, such as carbon tetrachloride or chloroform, can be used as the solvent for the azeotropic esterification.

Mixed esters are obtained by stepwise esterification, the less volatile monocarboxylic acids first being added and then, after an acid number of 2–3 mg of KOH/g is reached, the more volatile monocarboxylic acid being added in slight excess and the reaction being brought to completion.

The solvent, excess acid and catalyst are removed by suitable operations, such as filtration, distillation under a high vacuum or treatment with aqueous alkali solutions.

The carboxylic acid esters obtainable by a process according to the invention can be used as a base oil for the preparation of liquid or pasty lubricants. It is also possible to use the products together with other mineral and/or synthetic base lubricating oils, such as polyalkylene oxide-ester oils, polyolefine oils (synthetic hydrocarbon oils) or polyether oils.

The examples which follow show the superiority of the carboxylic acids according to the invention compared with known compounds. Since the order of magnitude of the viscosity and evaporation loss greatly depends on the alcohol component, each oil is compared with an ester oil of similar carbon number in which the same alcohol component is contained and the 6-cyclohexylhexanoic acid has been replaced by another monocarboxylic acid.

EXAMPLE A

Esters of 2-ethyl-propanediol

| | Ester A | Ester B (comparison) |
|---|---|---|
| acid component | 2 mols of cyclo-hexylhexanoic acid | 2 mols of n-dodecanoic acid |
| total number of carbon atoms | 29 | 29 |
| kinetic viscosity (50° C.)/100° C.) (CSt) | 24.0/6.16 | 10.8/3.85 |
| evaporation loss* | 5.6 | 22.7 |
| pour point (°C.) | −55 | +7 |
| flash point (°C.) | 209 | 240 |

x) in % after 168 hours at 170° C.

EXAMPLE B

Esters of 2,2-dimethyl-propane-1,3-diol

| | Ester C | Ester D (comparison) |
|---|---|---|
| acid component | 2 mols of cyclo-hexylhexanoic acid | 2 mols of 5,7,7-trimethyloctanoic acid |
| total number of carbon atoms | 29 | 27 |
| kinetic viscosity (50° C./100° C.) (cSt) | 26.3/6.49 | 13.5/4.01 |
| evaporation loss | 10.2 | 54.8 |

-continued

| | Ester C | Ester D (comparison) |
|---|---|---|
| pour point (°C.) | −42 | −50 |
| flash point (°C.) | 240 | 224 |

EXAMPLE C

Esters of 2-ethyl-2-methyl-propane-1,3-diol

| | Ester E | Ester F (comparison) |
|---|---|---|
| acid component | 2 mols of cyclo-hexylhexanoic acid | 2 mols of 5,7,7-trimethyloctanoic acid |
| total number of carbon atoms | 30 | 28 |
| kinetic viscosity (50° C./100° C.) (cSt) | 29.5/6.97 | 14.8/4.64 |
| evaporation loss | 10.5 | 63.7 |
| pour point (°C.) | −40 | −57 |
| flash point (°C.) | 250 | 225 |

EXAMPLE D

Esters of pentaerythritol

| | Ester G | Ester H |
|---|---|---|
| acid component | 2 mols of cyclo-hexylhexanoic acid 2 mols of 2-ethylhexanoic acid | 2 mols of n-dodecanoic acid 2 mols of 2-ethyl-hexanoic acid |
| total number of carbon atoms | 45 | 45 |
| kinetic viscosity (50° C./100° C.) (cSt) | 69.4/12.10 | 29.0/7.03 |
| evaporation loss | 10.4 | 10.8 |
| pour point (°C.) | −36 | −8 |
| flash point (°C.) | 265 | 265 |

EXAMPLE 1

(Ester Lubricating Oil A)

129 g of 2-ethylpropane-1,3-diol and 541 g of 6-cyclohexylhexanoic acid are boiled under reflux in 70 ml of xylene for 12 hours, using a water separator. Thereafter the mixture is distilled; the ester oil passes over at 245° C./0.5 mm Hg. It is extracted by shaking with 5% strength aqueous sodium hydroxide solution, washed with distilled water until neutral, dried with $Na_2SO_4$ and finally treated with basic aluminium oxide. The finished oil has an acid number of

COMPARISON EXPERIMENT B 156 g of 2-ethylpropane-1,3-diol and 660 g of n-dodecanoic acid are boiled under reflux with 70 ml of xylene for 20 hours, using a water separator, until the acid number has fallen to 28 mg of KOH/g. Thereafter, the mixture is distilled first under a waterpump vacuum and then under a high vacuum. The ester oil passes over at 232° C./0.03 mm Hg. This fraction is extracted by shaking with 5% strength aqueous sodium hydroxide solution, washed with distilled water until neutral, dried with sodium sulphate and finally treated with basic aluminium oxide. The finished oil has an acid number of less than 0.1 mg of KOH/g. Yield: 508 g.

EXAMPLE 2

(Ester Lubricating Oil C)

130 g of 2,2-dimethylpropane-1,3-diol, 605 g of 6-cyclohexylhexanoic acid and 13.8 g of tri-n-butyl phosphate are boiled under reflux in 70 ml of xylene for 42 hours, using a water separator. The mixture is then distilled under a high vacuum and the red ester oil which remains in the residue is treated as described in Example 1. The finished oil has an acid number of less than 0.15 mg of KOH/g. Yield: 408 g.

COMPARISON EXPERIMENT D 104 g of 2,2-dimethyl-propane-1,3-diol is boiled under reflux with 391 g of 5,7,7-trimethyloctanoic acid and 50 ml of xylene for about 30 hours, using a water separator, the mixture is distilled first under a waterpump vacuum and then under a high vacuum up to a sump temperature of 200° C. and the ester oil which is present in the residue is purified as described in the above examples. The final acid number is 0.03 mg of KOH/g. Yield: 403 g.

EXAMPLE 3

(Ester Lubricating Oil E)

The preparation is carried out analogously to Example 2, using 148 g of 2-ethyl-2-methyl-propane-1,3-diol, 605 g of 6-cyclohexylhexanoic acid and 14.1 g of tri-n-butyl phosphate as starting materials. The final acid number of the finished oil is less than 0.1 mg of KOH/g. Yield: 595 g.

COMPARISON EXPERIMENT F

The preparation is carried out analogously to Comparison Example D, using 201 g of 2-ethyl-2-methylpropane-1,3-diol, 664 g of 5,7,7-trimethyloctanoic acid and 18 g of tri-n-butyl phosphate as starting materials and with a reaction time of 12 hours. The final acid number is 0.1 mg of KOH/g. Yield: 616 g.

EXAMPLE 4

(Ester Lubricating Oil G)

163 g of pentaerythritol and 475 g of 6-cyclohexylhexanoic acid are boiled under reflux together with 20 g of tri-n-butyl phosphate in 100 ml of xylene for 11 hours, using a water separator. After this time, the acid number had fallen to a value between 3–4 mg of KOH/g. After adding 380 g of 2-ethylhexanoic acid, the mixture is boiled under reflux for a further 50 hours and, after driving off the xylene, the mixture is distilled under a high vacuum. The ester oil present in the residue is purified as described in Example 1. The final acid number is less than 0.1 mg of KOH/g. Yield: 715 g.

COMPARISON EXPERIMENT H

The preparation is carried out analogously to Example 4, using 204 g of pentaerythritol, 600 g of n-dodecanoic acid and 26 g of tri-n-butyl phosphate as starting materials and with a reaction time of 11 hours in the first stage, and adding 475 g of 2-ethylhexanoic acid and with a reaction time of 50 hours in the second stage. The final acid number here is 0.1 mg of KOH/g. Yield: 823 g.

We claim:

1. A carboxylic acid ester preparable by completely or partially esterifying an acid component with a polyhydric alcohol component, said acid component comprising 6-cyclohexylhexanoic acid and up to 75 mol % based on the total acid component of an aliphatic monocarboxylic acid having 4 to 20 carbon atoms and said polyhydric alcohol having at least one member selected from the group consisting of glycerol, dipentaerythritol, a compound of the formula

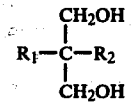

wherein $R_1$ and $R_2$ are the same or different and are hydrogen or alkyl having 1 to 5 carbon atoms and a compound of the formula

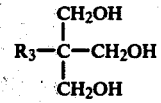

wherein $R_3$ is alkyl having 1 to 6 carbon atoms or hydroxymethyl.

2. The carboxylic acid ester of claim 1 wherein said acid component is completely esterified.

3. The carboxylic acid ester of claim 1 wherein the acid component consists of 6-cyclohexylhexanoic acid.

4. The carboxylic acid ester of claim 1 wherein said polyhydric alcohol component is of the formula

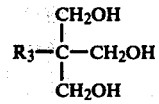

wherein $R_3$ is alkyl having 1 to 6 carbon atoms or hydroxymethyl.

5. The carboxylic acid ester of claim 1 wherein 0.8 to 1.3 acid equivalents per equivalent of OH group are employed for esterification.

6. A base oil for the preparation of liquid or pasty lubricants comprising the carboxylic acid ester of claim 1.

* * * * *